US012571204B2

(12) United States Patent
Snooks, Sr. et al.

(10) Patent No.: US 12,571,204 B2
(45) Date of Patent: Mar. 10, 2026

(54) CONCRETE EXPANSION JOINT INSERT INCLUDING A REMOVABLE PORTION

(71) Applicant: JD RUSSELL COMPANY, Utica, MI (US)

(72) Inventors: Charles Snooks, Sr., Shelby Township, MI (US); Bradley Danna, Shelby Township, MI (US); Nicholas Danna, Tucson, AZ (US)

(73) Assignee: JD RUSSELL COMPANY, Utica, MI (US)

( * ) Notice: Subject to any disclaimer, the term of this patent is extended or adjusted under 35 U.S.C. 154(b) by 207 days.

(21) Appl. No.: 18/154,336

(22) Filed: Jan. 13, 2023

(65) Prior Publication Data

US 2024/0240453 A1 Jul. 18, 2024

(51) Int. Cl.
*E04B 1/68* (2006.01)

(52) U.S. Cl.
CPC ..... *E04B 1/6812* (2013.01); *E04B 1/6801* (2013.01)

(58) Field of Classification Search
CPC .... E04B 1/6801; E04B 1/6812; E04B 1/6803; E04B 1/6804; E01C 11/10; E01C 11/103; E01C 11/106; E01C 23/021
USPC ..... 52/393, 396.02, 396.04; 404/47, 48, 64, 404/66
See application file for complete search history.

(56) References Cited

U.S. PATENT DOCUMENTS 1,329,631 A * 2/1920 Riehle ..... E01C 11/106 404/65
1,581,399 A * 4/1926 Fischer ..... E01C 23/021 404/87
1,701,629 A * 2/1929 Pullar ..... E01C 11/106 404/66
1,706,110 A * 3/1929 Fischer ..... E01C 11/106 404/40
1,809,393 A * 6/1931 Rockwell ..... E04F 15/02 52/99
1,880,725 A * 10/1932 Bleck ..... E01C 23/021 404/48
1,884,647 A * 10/1932 Gage ..... E01C 11/12 404/50
1,890,954 A * 12/1932 Snyder ..... E04F 15/14 52/390
2,045,089 A * 6/1936 Kyte ..... E01C 11/126 404/47

(Continued)

OTHER PUBLICATIONS

What's in Homasote® Board in Addition to Post-Consumer Paper?, Raj Nagubadi, https://www.homasote.com/whatisit/, accessed Aug. 25, 2025 (Year: 2025).*

*Primary Examiner* — James M Ference

(74) *Attorney, Agent, or Firm* — Carlson, Gaskey & Olds, P.C.

(57) ABSTRACT

A concrete expansion joint insert includes a body having a length between a first end and a second end, a thickness between a first side and a second side, and a height between a first edge and a second edge. The body includes a first portion having the thickness, the length, and a first amount of the height. The body includes a second portion having the thickness, the length and a second amount of the height. The first portion of the body is predisposed to be separable from the second portion of the body. A separation support member is situated within the first portion along a substantial portion of the length.

19 Claims, 6 Drawing Sheets

(56) References Cited

U.S. PATENT DOCUMENTS 2,066,052 A * 12/1936 Plym ..... E01C 11/14 404/58
2,111,114 A * 3/1938 Fisher ..... E01C 11/126 404/67
2,368,650 A * 2/1945 Fischer ..... E04B 1/6812 404/48
2,479,434 A * 8/1949 Van London ..... E01C 11/106 404/74
2,554,522 A * 5/1951 Carter ..... B29D 99/0053 156/304.6
2,895,865 A * 7/1959 Humphner ..... C09J 7/21 428/113
2,899,876 A * 8/1959 Tauber et al. ..... E01C 11/10 404/48
2,967,467 A * 1/1961 Maude ..... E01C 23/021 404/66
3,124,047 A * 3/1964 Graham ..... E01C 11/10 52/396.04
3,157,097 A * 11/1964 Stinnett, Jr. ..... E01C 11/106 52/127.3
3,308,726 A * 3/1967 Dreher ..... E01C 11/126 404/67
3,330,187 A * 7/1967 Kohler ..... E01C 11/10 264/173.17
3,334,557 A * 8/1967 Fitzgibbon ..... E01C 11/103 521/918
3,352,217 A * 11/1967 Peters ..... E01C 11/106 404/65
3,411,260 A * 11/1968 Dill ..... E01C 11/10 404/48
3,418,899 A * 12/1968 Fujihara ..... E01C 23/021 404/74
3,460,447 A * 8/1969 Grenzeback ..... E01C 11/12 404/67
3,461,781 A * 8/1969 Weiner ..... E04B 1/6812 404/48
3,494,538 A * 2/1970 Matthews ..... B65D 75/66 206/481
3,512,318 A * 5/1970 Turner ..... E06B 1/26 52/204.591
3,589,664 A * 6/1971 Middlestadt ..... E01C 23/021 249/150
3,629,986 A * 12/1971 Klittich ..... E01C 11/106 404/69
3,713,263 A * 1/1973 Mullen ..... E04D 13/151 52/396.04
3,799,389 A * 3/1974 Block ..... B65D 17/462 220/279
3,813,180 A * 5/1974 O'Brill ..... B65D 79/00 404/66
3,827,204 A * 8/1974 Walters ..... E04F 15/02 404/66
3,838,930 A * 10/1974 Koch ..... E01C 23/021 404/48
3,884,000 A * 5/1975 Faleij ..... E04B 1/6807 52/127.3
3,896,597 A * 7/1975 Deason ..... E01C 11/106 52/396.02
4,023,324 A * 5/1977 Majeske ..... E01C 11/10 52/204.591
RE29,377 E * 8/1977 O'Brill ..... B65D 79/00 404/66
4,050,206 A * 9/1977 Utsuyama ..... E01C 11/126 52/396.02
4,058,947 A * 11/1977 Earle ..... E04B 1/6801 404/66
4,090,800 A * 5/1978 Koch ..... E01C 11/10 404/48
4,098,047 A * 7/1978 Weber ..... E01C 11/106 404/68
4,193,211 A * 3/1980 Dotsko ..... G09B 25/08 434/152
4,287,696 A * 9/1981 Mullen ..... E01C 23/0986 52/309.7
4,343,121 A * 8/1982 Kruschwitz ..... B60J 10/70 52/204.597
4,346,542 A * 8/1982 Tateno ..... E01C 11/106 52/396.02
4,388,016 A * 6/1983 Levey ..... E01C 11/106 404/48
4,401,716 A * 8/1983 Tschudin-Mahrer ..... E04B 1/6812 428/319.7
4,669,245 A * 6/1987 Lucas ..... E01C 11/106 52/372
4,699,540 A * 10/1987 Gibbon ..... E01D 19/06 404/49
4,889,445 A * 12/1989 Vittone ..... E01C 23/026 404/69
4,952,104 A * 8/1990 Osada ..... E04F 13/02 156/247
5,190,395 A * 3/1993 Cathey ..... E01D 19/06 404/69
6,039,503 A * 3/2000 Cathey ..... E01D 19/06 404/69
6,418,688 B1 * 7/2002 Jones, Jr. ..... E04B 1/6812 404/66
6,616,877 B2 * 9/2003 Close ..... B24D 15/02 264/912
6,817,819 B2 * 11/2004 Olson ..... B65D 17/462 220/309.1
6,993,874 B2 * 2/2006 Trout ..... E04B 1/6801 52/396.04
6,997,640 B1 * 2/2006 Hohmann, Jr. ..... E04B 1/6801 14/73.1
8,318,304 B2 * 11/2012 Valenziano ..... C09K 21/00 428/372
8,578,672 B2 * 11/2013 Mattox ..... E04B 1/948 52/396.04
9,404,581 B1 * 8/2016 Robinson ..... F16J 15/104
D765,491 S * 9/2016 Jaycock ..... E04G 11/06 D8/354
9,822,525 B2 * 11/2017 Shin ..... E01C 11/04
10,132,091 B2 * 11/2018 Wilkes, Jr. ..... E02D 29/16
10,203,035 B1 * 2/2019 Robinson ..... F16J 15/108
10,213,962 B2 * 2/2019 Robinson ..... B29C 66/00
10,480,654 B2 * 11/2019 Robinson ..... B32B 7/12
10,577,760 B2 * 3/2020 Robinson ..... E01C 23/0973
10,851,897 B2 * 12/2020 Robinson ..... B32B 5/18
11,313,118 B2 * 4/2022 Robinson ..... E04B 1/6801
2004/0035075 A1 * 2/2004 Trout ..... E04B 1/6812 52/571
2004/0187235 A1 * 9/2004 Elias ..... E01D 19/06 14/73.1
2005/0141961 A1 * 6/2005 Steffes ..... E01C 23/025 404/75
2006/0117692 A1 * 6/2006 Trout ..... E04B 1/6812 52/393
2007/0175172 A1 * 8/2007 Sousa ..... F16J 15/062 52/741.1
2010/0307102 A1 * 12/2010 Barnett ..... E01C 11/10 52/745.19
2012/0082512 A1 * 4/2012 Cureton ..... E01C 11/06 404/87
2016/0097203 A1 * 4/2016 Rodler ..... E04F 13/06 52/393
2017/0159817 A1 * 6/2017 Robinson ..... B32B 7/12
2018/0163349 A1 * 6/2018 Danna ..... E04B 1/68
2018/0163393 A1 * 6/2018 Danna ..... E04B 1/6801
2018/0363292 A1 * 12/2018 Robinson ..... F16J 15/065
2019/0063608 A1 * 2/2019 Robinson ..... B32B 3/02
2019/0390418 A1 * 12/2019 Robinson ..... E01C 11/103
2020/0347590 A1 * 11/2020 Robinson ..... E04B 1/6812
2023/0311399 A1 * 10/2023 Snooks, Sr. ..... B29C 48/022 264/176.1
2024/0240453 A1 * 7/2024 Snooks, Sr. ..... E04B 1/6812

* cited by examiner

CONCRETE EXPANSION JOINT INSERT INCLUDING A REMOVABLE PORTION

BACKGROUND

Concrete has been in widespread use for a variety of surfaces, including roads and walkways. Given that concrete is a generally porous material and is exposed to changing weather conditions, expansion joints between sections or slabs of concrete accommodate expansion and contraction of the concrete. Many expansion joints include an insert or filler within the space between the sections or slabs of concrete. Traditional expansion joint inserts were made using materials such as wood, paper and asphalt. More recently, recycled rubber expansion joint inserts were introduced.

SUMMARY

A concrete expansion joint insert includes a body having a length between a first end and a second end, a thickness between a first side and a second side, and a height between a first edge and a second edge. The body includes a first portion having the thickness, the length, and a first amount of the height. The body includes a second portion having the thickness, the length and a second amount of the height. The first portion of the body is predisposed to be separable from the second portion of the body. A separation support member is situated within the first portion along a substantial portion of the length.

In an example embodiment having at least one of the features of the concrete expansion joint insert of the previous paragraph, the second amount of the height is larger than the first amount of the height.

In an example embodiment having at least one of the features of the concrete expansion joint insert of any of the previous paragraphs, the separation support member comprises a metal wire.

In an example embodiment having at least one of the features of the concrete expansion joint insert of any of the previous paragraphs, the separation support member comprises a polymer material.

In an example embodiment having at least one of the features of the concrete expansion joint insert of any of the previous paragraphs, the separation support member includes a segment that at least partially extends out of at least one of the first and second ends.

In an example embodiment having at least one of the features of the concrete expansion joint insert of any of the previous paragraphs, the first portion is configured to be separated from the second portion upon applying a force on the segment of the separation support member.

In an example embodiment having at least one of the features of the concrete expansion joint insert of any of the previous paragraphs, the body includes a separation feature along at least a portion of an interface between the first portion and the second portion.

In an example embodiment having at least one of the features of the concrete expansion joint insert of any of the previous paragraphs, the separation feature comprises at least one of: a perforation, a weakness, a deformation, a stress concentration, or a reduced thickness.

In an example embodiment having at least one of the features of the concrete expansion joint insert of any of the previous paragraphs, the body comprises recycled rubber.

A method of making a concrete expansion joint insert includes forming a body comprising a first material; including a separation support member within a portion of the body, the separation support member comprising a second material that is different from the first material; and predisposing the portion of the body to be separable from a remainder of the body.

In an example embodiment having at least one of the features of the method of the previous paragraph, the including comprises situating the separation support member along at least a substantial length of the portion of the body.

In an example embodiment having at least one of the features of the method of any of the previous paragraphs, the separation support member comprises a wire.

In an example embodiment having at least one of the features of the method of any of the previous paragraphs, the including comprises including the second material in the forming such that the second material extends along at least a substantial length of the portion, the first material comprises recycled rubber, and the second material comprises a polymer.

In an example embodiment having at least one of the features of the method of any of the previous paragraphs, the second material has a melting temperature that is higher than a melting temperature of the first material.

The various features and advantages of at least one disclosed example embodiment will become apparent to those skilled in the art from the following description. The drawings that accompany the detailed description can be briefly described as follows.

DETAILED DESCRIPTION

Figure 1:
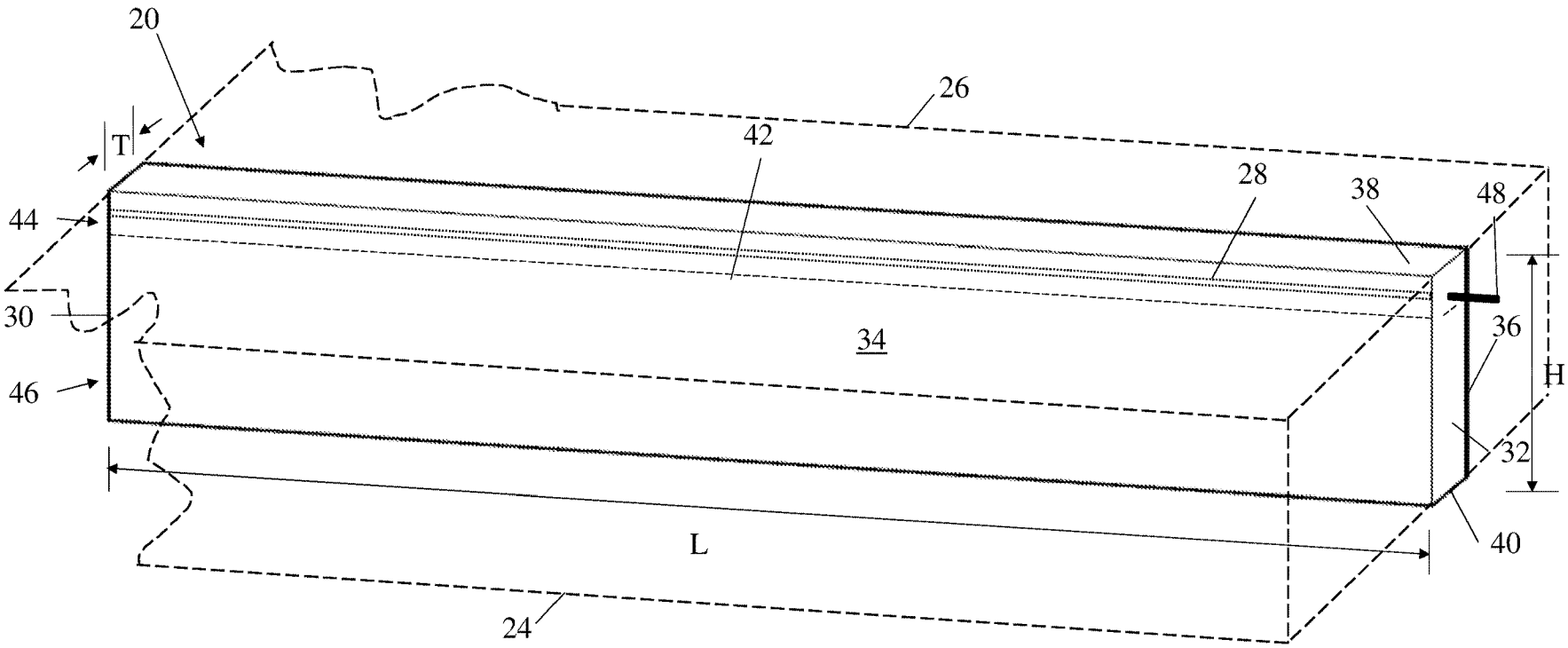
FIG. 1 is a perspective view that diagrammatically illustrates a concrete expansion joint insert designed according to an example embodiment.

FIG. 1 shows a concrete expansion joint insert 20 within an expansion joint between two sections or slabs of concrete 24 and 26. In this example, the insert 20 includes a body having dimensions that correspond to the desired size of the expansion joint. A length L extends between a first end 30 and a second end 32, a thickness T extends between a first side 34 and a second side 36, and a height H extends between a first edge 38 and second edge 40.

The insert 20 is made or formed with the height H and thickness T. The insert 20 may be premade at the length L or be cut to length to establish the length L.

In some examples, the height H varies between two inches and twelve inches. Many concrete installations include slabs that have a thickness on the order of 3.5 inches, 4 inches or 6 inches. The height H is selected to correspond to the thickness of the concrete in such examples.

The thickness T may vary between 0.25 inches and 1 inch. Many expansion joints have a gap size of approximately one-half inch and the insert 20 will have a thickness T of one-half inch for such installations.

The insert 20 may comprise various materials. In some examples, the insert comprises recycled rubber. In other embodiments the insert comprises one of: wood fibers impregnated with asphalt, asphalt with minerals such as sand added between two layers of tar paper, recycled newspaper bonded under pressure and containing wax, recycled vinyl, cork, rebounded rubber, or neoprene and wood strips.

Figure 2:
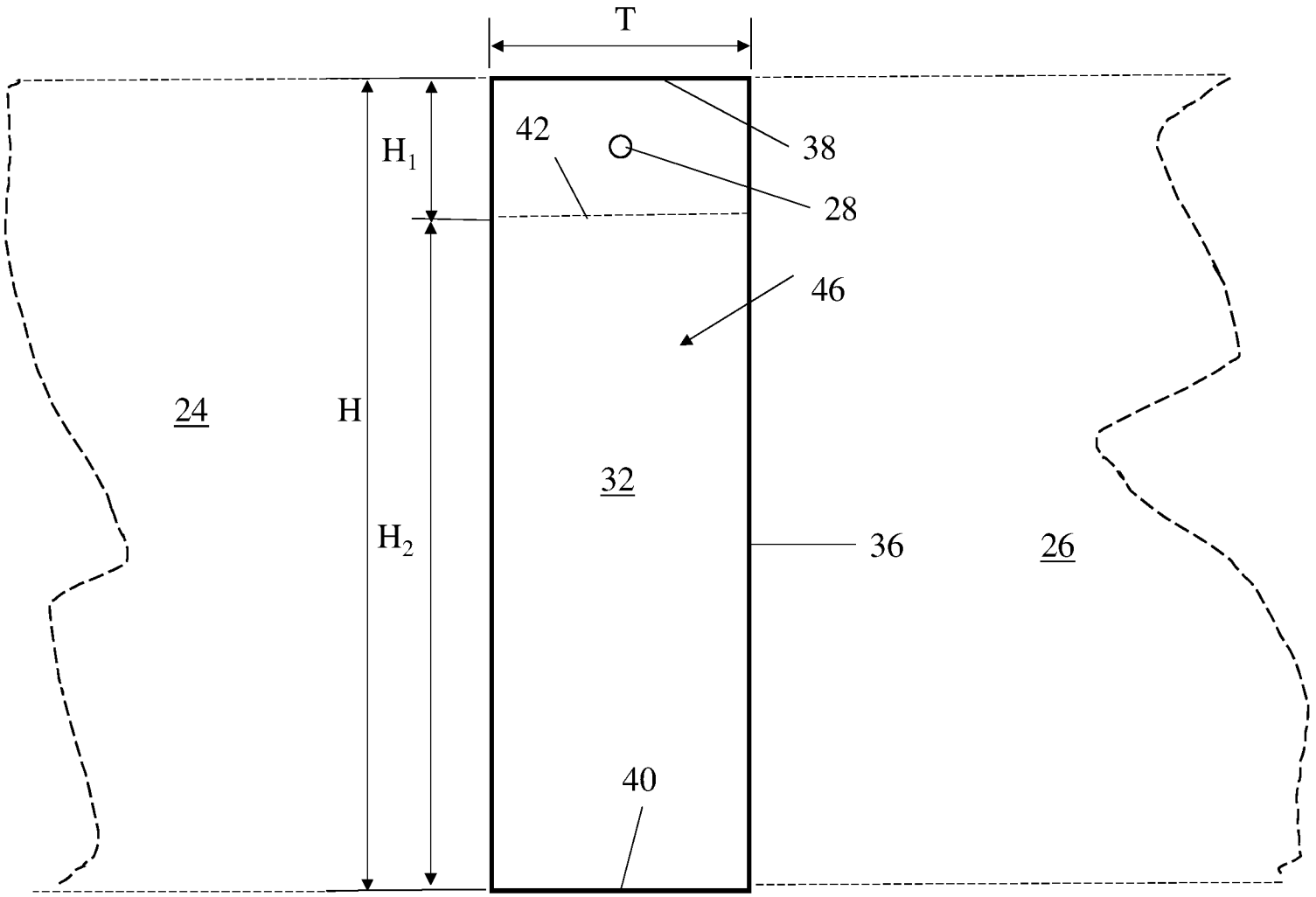
FIG. 2 is an end view of the expansion joint insert shown in FIG. 1.
Figure 3:
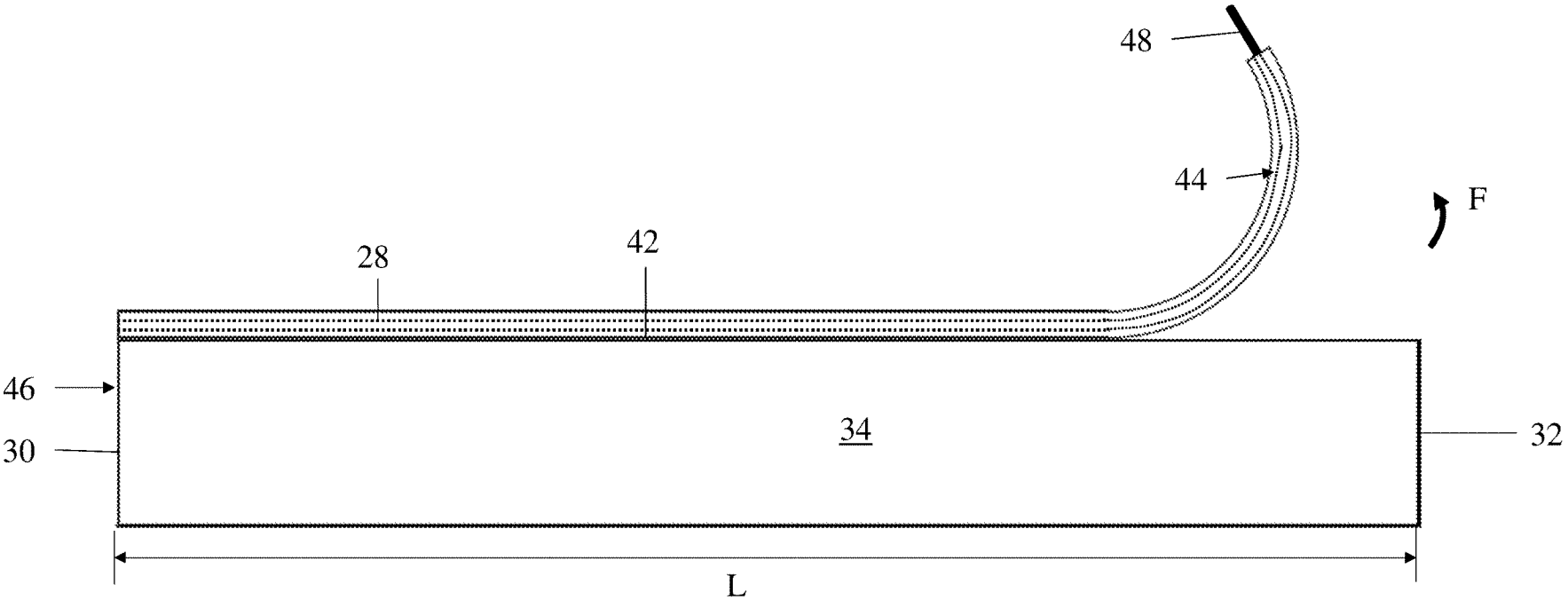
FIG. 3 schematically illustrates separating a first portion from a second portion of the expansion joint insert of FIGS. 1 and 2.

The body includes a separation feature 42 that is configured to facilitate separation of a first portion 44, which extends between the separation feature 42 and the edge 38, from a second portion 46, which extends between the separation feature 42 and the edge 40. As shown in FIGS. 1-3, the separation feature 42 is situated along a substantial portion of the length L between the first end 30 and the second end 32 and across a substantial portion of the thickness T between the first side 34 and the second side 36. In some examples, the separation feature 42 extends along the entire interface between the first portion 44 and the second portion 46.

The separation feature 42 is established in the material of the body of the insert 20 without introducing any other material between the first portion 44 and the second portion 46. The separation feature 42 in the illustrated example embodiment includes a perforated segment of the material of the body of the insert 20. In other embodiments, the separation feature 42 includes a weakness or stress concentration in the material of the body of the insert 20, such as recycled rubber. In other embodiments, the separation feature 42 includes a deformation or a reduced thickness of the body material of the insert 20 along the interface between the first portion 44 and the second portion 46.

In some examples, as shown in FIGS. 2 and 3, the first portion 44 includes the length L, the thickness T, and a first height $H_1$. The second portion 46 includes the length L, the thickness T, and a second height $H_2$, which is greater than the first height $H_1$.

The separation support member 28 member is situated within the first portion 44 along a substantial portion of the length L to facilitate separating the first portion 44 from the second portion 46. In one example, the separation support member 28 includes a segment 48 that at least partially extends out of at least one of the ends 30, 32. An individual can grasp the segment 48 by hand or with a tool and begin to pull the first portion 44 away from the second portion 46 by applying a force F as schematically shown in FIG. 3. Pulling on the segment 48 makes it easier to begin removing the first portion 44. After one end of the first portion 44 is apart from the second portion 46, an individual can grasp the material of the first portion 44 to continue pulling the first portion 44 away.

The separation support member 28 provides reinforcement and support within the first portion 44 to prevent first portion 44 from breaking into segments as the first portion 44 is manipulated to separate the first portion 44 from the second portion 46. A thin layer of recycled rubber material, such as the first portion 44, has a tendency to break in segments during a pulling movement like that shown in FIG. 3. Even with the separation feature 42, the way in which the body of the insert is made makes it difficult to remove the entire first portion 44 all in one piece without breaking. The separation support member 28 has enough tensile strength to resist breaking while the first portion 44 is pulled away from the second portion 46. With the separation support member 28 in the first portion 44, an individual can separate the first portion 44 from the second portion 46 all in one piece and possibly in one continuous motion to remove the entire length of the first portion 44.

Figure 4:
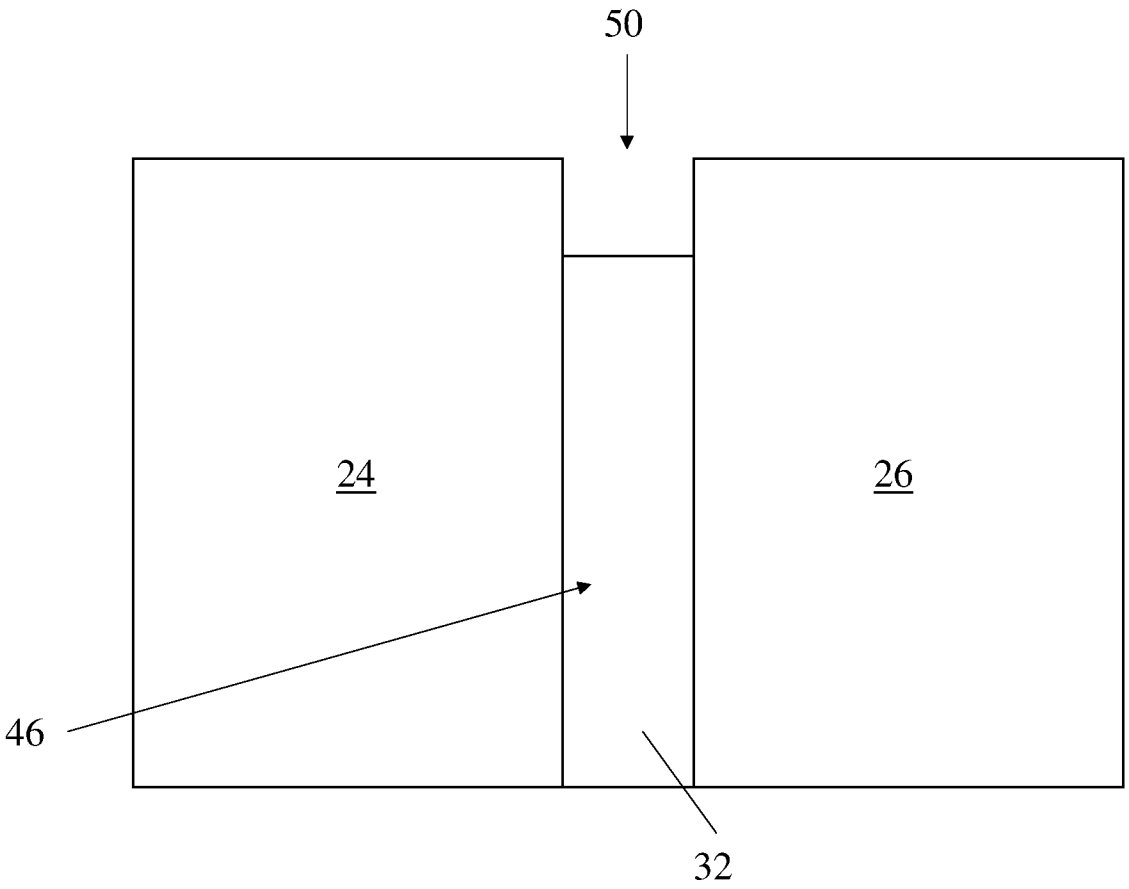
FIG. 4 illustrates a condition of an expansion joint after the first portion is removed.
Figure 5:
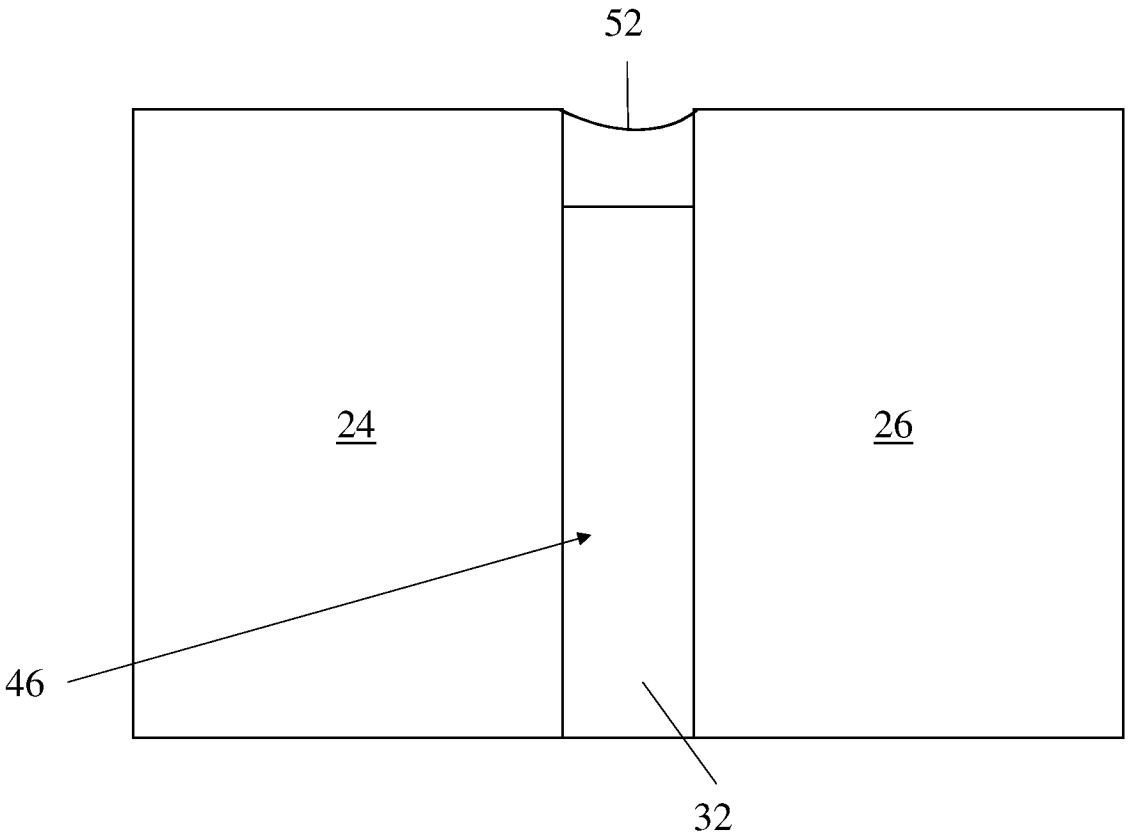
FIG. 5 illustrates the expansion joint after a sealant has been inserted into the expansion joint.

FIG. 4 schematically illustrates, from an end view, the result of separating the first portion 44 from the second portion 46 when the insert 20 is situated in an expansion joint between slabs 24, 26 of concrete. When installed, the top edge 38 of the insert 20 is aligned with the top surfaces of the concrete slabs as shown in FIG. 1. After the first portion 44 is removed, a top of the second portion 46 is below the top of the concrete slabs. As shown in FIG. 5, the resulting gap 50 can be filled with a sealant 52 to reduce the likelihood of water entering the expansion joint. Removing the first portion 44 makes it easier for a worker at the site where the concrete and insert 20 were installed to fill the top section of the expansion joint with sealant.

With the separation feature 42 along the interface between the first portion 44 and the second portion 46, the first portion 44 is predisposed to be separable from the second portion 46. With the separation support member 28 in place, the first portion 44 is removed in one piece along the entire length L. As shown in FIGS. 4 and 5, once the first portion 44 is removed, the second portion 46 remains situated between the concrete slabs 24 and 26.

Figure 6:
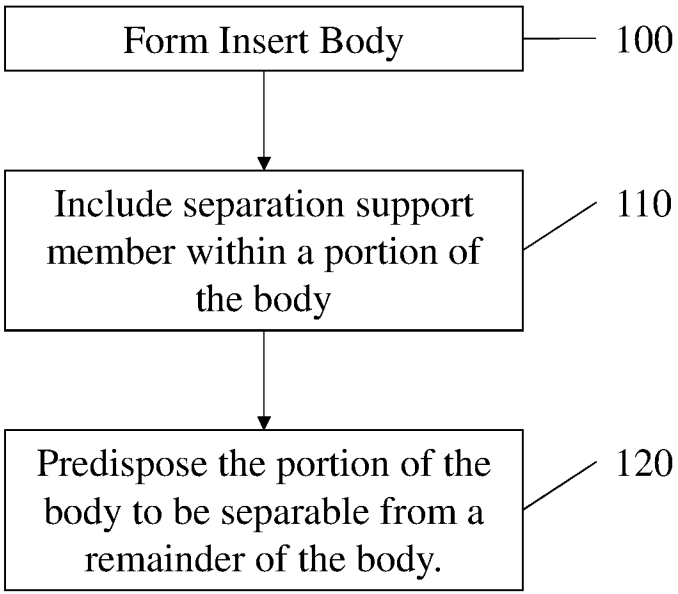
FIG. 6 is a flowchart diagram summarizing an example method of making concrete joint inserts.

FIG. 6 summarizes an example method for making an insert 20. At 100, the body of the insert 20 is formed, for example by extruding the body using a die that establishes the height H and thickness T dimensions that are preset to correspond to the final desired dimensions of the expansion joint insert 20. In an example embodiment, the body comprises a first material, such as recycled rubber, that is extruded at a controlled temperature in a range between 320° F. and 400° F.

At 110, during the forming process, the separation support member 28 is included within the first portion 44 of the body. The separation support member 28 comprises a second material that is different from the first material. The second material has a melting temperature that is higher than the melting temperature of the first material. The second material is capable of retaining or establishing a desired shape of the separation support member 28 at temperatures up to 500° F.

In some examples, the separation support member 28 is preformed, such as a wire or thread, and inserted into the die while the first material of the insert body is extruded through the die. In one embodiment, an end of a wire or thread on a spool is introduced into the material of the body of the insert, such as melted resin and rubber, as that material flows through an extrusion die. The material carries the wire or thread through the die in a manner that the wire or thread continues to be fed into the die from the spool (or other supply) and situated within the first portion 44 as shown in FIGS. 1 and 2. The die in some embodiments includes a separation support member feeder inlet, such as a tube, through which the wire or thread is introduced into the flowing body material at the cross-sectional location in the first portion 44 where the separation support member 44 is situated in the fully formed expansion joint insert 20.

In one example embodiment, the separation support member 28 is a metal wire. Copper is used in some embodiments. Other example wires comprise steel or aluminum. In some embodiments, the wire is the type that is useful for electrical discharge machining (EDM).

In another example, the separation support member 28 comprises a polymer material, such as a high strength nylon. Some embodiments include a thread, cord or strand of polymer material that is strong enough to resist breaking while the first portion 44 is pulled away from the second portion 46. High tensile strength, no-break polymer strands or cords are included in some embodiments.

In some embodiments, the polymer separation support member 28 is formed while making the body of the insert 20 and the portions of the method shown at 100 and 110 in FIG. 6 are performed simultaneously. For example, a polymer material is injected or otherwise introduced into the material forming the body of the insert 20 during an extrusion process to form a line or continuous bead of polymer material that reinforces the first portion 44 so it remains in one piece when being separated from the second portion 46.

In an example embodiment, the material of the body of the insert 20 comprises recycled rubber and a resin. The separation support member 28 is formed by extruding or otherwise introducing the resin (without being mixed with the rubber) through a high heat tube that directs the resin into the flow of the rubber and resin material while the body of the insert 20 is being formed. As the body material flows through an extrusion die, for example, the polymer resin occupies a part of the cross-section of the first portion 44 along the length of the insert 20 to establish the separation support member 28. Once the material of the body and the polymer material of the separation support member 28 cure, the separation support member 28 has the tensile strength and stability needed to support the first portion 44 during separation from the second portion 46.

At 120, the separation feature 42 is established along the interface between the first portion 44 and the second portion 46. In some embodiments, a blade cuts a slit in at least one of the sides 34, 36 along the length L of the body of the insert 20. The blade may penetrate into the body far enough to result in a cut that will facilitate separating the first portion 44 from the second portion 46 while still leaving enough of a connection between those portions so the insert 20 is stable during shipment, handling and installation.

One example arrangement for cutting a slit to establish the separation feature 42 includes a first oscillating saw blade situated to cut into the side 34 and a second oscillating saw blade situated to cut into the side 36. That arrangement includes a support, such as a conveyor or a set of rollers, for passing the formed and cooled insert 20 through the space including the oscillating saw blades.

In other embodiments, a perforating wheel engages at least one of the sides 34, 36 to establish a perforation along the interface between the first portion 44 and the second portion 46.

The disclosed example embodiments and others like them include a concrete expansion joint insert having a tab or portion that can be pulled out of the joint between two slabs of concrete. With a separation support member, such as those described above, the insert can be made of a variety of materials and the tab or portion that is separated from the rest of the insert without breaking during separation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A concrete expansion joint insert comprising:

a body having a length between a first end and a second end, a thickness between a first side and a second side, and a height between a first edge and a second edge, the body comprising recycled rubber including a first portion having the thickness, the length, and a first amount of the height, the body including a second portion having the thickness, the length and a second amount of the height, the first portion of the body being predisposed to be separable from the second portion of the body; and a separation support member embedded within the first portion and extends uninterrupted from the first end to the second end along the length, wherein the body comprises a first material and the separation support member comprises a second material with a melting temperature greater than a melting temperature of the first material.

2. The concrete expansion joint insert of claim 1, wherein the second amount of the height is larger than the first amount of the height.

3. The concrete expansion joint insert of claim 1, wherein the separation support member comprises a metal wire.

4. The concrete expansion joint insert of claim 1, wherein the separation support member comprises a polymer material.

5. The concrete expansion joint insert of claim 1, wherein the separation support member includes a segment that at least partially extends out of at least one of the first and second ends.

6. The concrete expansion joint insert of claim 5, wherein the first portion is configured to be separated from the second portion upon applying a force on the segment of the separation support member.

7. The concrete expansion joint insert of claim 1, wherein the body includes a separation feature along at least a portion of an interface between the first portion and the second portion.

8. The concrete expansion joint insert of claim 7, wherein the separation feature comprises at least one of: a perforation, a weakness, a deformation, a stress concentration, or a reduced thickness.

9. The concrete expansion joint insert of claim 1, wherein the thickness comprises a solid thickness of the recycled rubber between the first side and the second side.

10. The concrete expansion joint insert of claim 1, wherein the first amount of the height and the second amount of the height comprise a solid thickness of the recycled rubber.

11. A concrete expansion joint insert comprising:

a body comprising a solid material having a length between a first end and a second end, a thickness between a first side and a second side, and a height between a first edge and a second edge, the body including a first portion having the thickness, the length, and a first amount of the height, the body including a second portion having the thickness, the length and a second amount of the height, the first portion of the body being predisposed to be separable from the second portion of the body, wherein the second amount of the height is larger than the first amount of height; and a separation support member embedded within the first portion along at least the length of the body and configured to resist breaking of the first portion while the first portion is separated from the second portion, wherein the separation support member comprises a material having a melting temperature greater than a melting temperature of the solid material of the body.

12. The concrete expansion joint insert of claim 11, wherein the separation support member includes a segment that at least partially extends out of at least one of the first and second ends.

13. The concrete expansion joint insert of claim 11, wherein the first portion is configured to be separated from the second portion upon applying a force on the segment of the separation support member.

14. The concrete expansion joint insert of claim 11, wherein the body includes a separation feature along at least a portion of an interface between the first portion and the second portion.

15. The concrete expansion joint insert of claim 14, wherein the separation feature comprises at least one of: a perforation, a weakness, a deformation, a stress concentration, or a reduced thickness.

16. A concrete expansion joint insert comprising:

a body comprising a solid material having a length between a first end and a second end, a thickness between a first side and a second side, and a height between a first edge and a second edge, the body including a first portion having the thickness, the length, and a first amount of the height, the body including a second portion having the thickness, the length and a second amount of the height, the first portion of the body being predisposed to be separable from the second portion of the body, wherein the second amount of the height is larger than the first amount of height; and a separation support member embedded within the first portion along at least the length of the body and configured to resist breaking of the first portion while the first portion is separated from the second portion, wherein the separation support member comprises a material having a melting temperature greater than a melting temperature of the solid material of the body and the separation support member includes a segment that at least partially extends out of at least one of the first and second ends.

17. The concrete expansion joint insert of claim 16, wherein the first portion is configured to be separated from the second portion upon applying a force on the segment of the separation support member.

18. The concrete expansion joint insert of claim 16, wherein the body includes a separation feature along at least a portion of an interface between the first portion and the second portion.

19. The concrete expansion joint insert of claim 18, wherein the separation feature comprises at least one of: a perforation, a weakness, a deformation, a stress concentration, or a reduced thickness.

* * * * *